US007146974B2

(12) United States Patent
Scherer

(10) Patent No.: US 7,146,974 B2
(45) Date of Patent: Dec. 12, 2006

(54) BLOCK SPLITTING ASSEMBLY AND METHOD

(75) Inventor: Ronald J. Scherer, Shakopee, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 10/940,062

(22) Filed: Sep. 13, 2004

(65) Prior Publication Data

US 2006/0054154 A1 Mar. 16, 2006

(51) Int. Cl.
*B23D 1/32* (2006.01)

(52) U.S. Cl. ..... 125/23.01; 125/40

(58) Field of Classification Search ..... 125/23.01, 125/40, 24, 30.01

See application file for complete search history.

(56) References Cited

U.S. PATENT DOCUMENTS

| | | | |
|---|---|---|---|
| 470,788 | A | 3/1892 | Lachapelle et al. |
| 806,951 | A | 12/1905 | Bryning |
| 1,534,353 | A | 4/1925 | Besser |
| 1,893,430 | A | 1/1933 | McKenzie |
| 2,593,606 | A | 4/1952 | Price |
| 2,746,447 | A | 5/1956 | Petch |
| 2,775,236 | A | 12/1956 | Blum |
| 2,867,205 | A | 1/1959 | Vesper |
| 2,881,753 | A | 4/1959 | Entz |
| 2,925,080 | A | 2/1960 | Smith |
| 3,120,842 | A | 2/1964 | Cox et al. |
| 3,392,719 | A | 7/1968 | Clanton et al. |
| 3,559,631 | A | 2/1971 | Mangis |
| 3,809,049 | A | 5/1974 | Fletcher et al. |
| 4,250,863 | A | 2/1981 | Gagnon et al. |
| 4,335,549 | A | 6/1982 | Dean, Jr. |
| 5,066,070 | A | 11/1991 | Clarke |
| 5,152,275 | A | 10/1992 | Landhuis |
| 5,413,086 | A | 5/1995 | Trudeau |
| 5,662,094 | A | 9/1997 | Giacomelli |
| 5,687,515 | A | 11/1997 | Rodrigues et al. |
| 5,722,386 | A | 3/1998 | Fladgard et al. |
| 5,762,061 | A | 6/1998 | Bevan |

(Continued)

FOREIGN PATENT DOCUMENTS

EP 0 294 267 A1 12/1988

(Continued)

OTHER PUBLICATIONS

U.S. Appl. No. 09/691,864, entitled "Block Splitting Assembly and Method," filed Oct. 19, 2000.

(Continued)

*Primary Examiner*—Robert A. Rose
(74) *Attorney, Agent, or Firm*—Merchant & Gould PC

(57) ABSTRACT

A concrete block is produced from a workpiece that is split by a plurality of splitting assemblies, each of which comprises a multiplicity of peaks, for example alternating ridges and valleys. A splitting assembly is positioned to engage each of the top, bottom and side surfaces of the workpiece, whereby a block resulting from the splitting process an irregular front face and has a front face with irregular top, bottom and side edges. The resulting block can be a concrete masonry block that is laid up in a wall with other like blocks with mortar between the blocks, or any other concrete block product.

22 Claims, 5 Drawing Sheets

U.S. PATENT DOCUMENTS

| | | | |
|---|---|---|---|
| 6,050,255 | A | 4/2000 | Sievert |
| 6,102,026 | A | 8/2000 | Fladgard et al. |
| 6,321,740 | B1 | 11/2001 | Scherer et al. |
| 6,401,707 | B1 | 6/2002 | Fladgard et al. |
| D464,145 | S | 10/2002 | Scherer et al. |
| 6,460,534 | B1 | 10/2002 | Vasquez et al. |
| D482,133 | S | 11/2003 | Scherer et al. |
| 2002/0015620 | A1 | 2/2002 | Woolford et al. |
| 2002/0092257 | A1 | 7/2002 | Scherer et al. |
| 2003/0180099 | A1 | 9/2003 | Scherer et al. |
| 2004/0200468 | A1 | 10/2004 | Scherer et al. |
| 2004/0221545 | A1 | 11/2004 | Scherer |

FOREIGN PATENT DOCUMENTS

| | | |
|---|---|---|
| GB | 1 245 921 | 9/1971 |
| GB | 1 509 747 | 5/1978 |

OTHER PUBLICATIONS

"Besser Rustic Machine," http://www.besser.com/equipment/productenhance/rustic.htm, 2 pages (Date Printed Dec. 1, 2004).

"Fairlane Positioning and Workholding Products," http: www.fairlaneprod.com.index.htm, Fairlane Products Inc., 2 pages (Date Printed Nov. 15, 2001).

"Rockwood Retaining Walls, The Rustic™ process," http://www.rockwoodwalls.com/rustic/, 2 pages (Copyright 2003-2004).

"Rustic Surface Aging Machine," *Besser*, 2 pages, Printed Dec. 1, 2004 from http://www.besser.com/equipment/productenhance/Rustic.pdf.

Declaration of Michael S. Lidbom.

BLOCK SPLITTING ASSEMBLY AND METHOD

FIELD OF THE INVENTION

The invention relates generally to the manufacture of concrete blocks. More specifically, the invention relates to equipment and processes for the creation of decorative faces on concrete blocks. Even more specifically, the invention relates to equipment and processes for producing irregular textures and the appearance of weathered or rock-like edges on concrete blocks. The blocks may be concrete masonry blocks in which mortar is used between the blocks when the blocks are laid up in courses to secure the blocks to one another, concrete retaining wall blocks which are dry stacked in ascending courses, or other concrete blocks.

BACKGROUND OF THE INVENTION

Concrete blocks have been a basic building material for many years. Concrete blocks have been designed for use in many applications, including concrete masonry blocks used in the construction of foundations of residential and commercial buildings, as well as in constructing the interior and exterior walls of such buildings, and concrete retaining wall blocks used to construct retaining walls. Concrete masonry blocks are typically laid up in courses with mortar being used to secure the blocks to one another, while concrete retaining wall blocks are typically dry stacked in ascending courses without the use of mortar.

One example of a concrete masonry block is the well known gray building block. A common use for these blocks has been in the construction of residential basements, where the gray blocks are laid up with mortar between the blocks to form the walls of such basements. However, the outside exposed walls formed by such blocks are visually plain and unattractive.

Architectural concrete masonry blocks and retaining wall blocks are available in a variety of shapes, sizes, colors and textures. One way to enhance the visual appearance of such concrete blocks is to make the front face less uniform and more "natural" appearing. This can be done by using a splitting process to create an irregular front face, often referred to as a "rock-face", on the block. In this process, as it is commonly practiced, a relatively large concrete workpiece which has been adequately cured is split to form two or more relatively smaller blocks. The resulting blocks have faces that are somewhat textured and irregular along the plane(s) of splitting. This process of splitting a workpiece into two or more blocks to create an irregular rock-like appearance on the exposed faces of the blocks is shown, for example, in Besser's U.S. Pat. No. 1,534,353, which discloses the manual splitting of blocks using a hammer and chisel.

Automated equipment to split a concrete workpiece to form blocks is well-known, and generally includes a splitting apparatus comprising a supporting table and opposed, mechanically-actuated or hydraulically-actuated, top and bottom splitting blades. A splitting blade in this application is typically a substantial steel plate that is tapered to a relatively narrow, or "sharp", knife edge. A blade typically comprises one or more straight segments—although the blade segments can be curved as well—, with the top and bottom blades being mirror images of one another. The blades typically are arranged so that the knife edge of the top blade will engage the top surface of the workpiece, and the knife edge of the bottom blade will engage the bottom surface of the workpiece, with the blades aligned and perpendicular to the top and bottom surfaces of the workpiece. In operation, the workpiece is moved onto the supporting table and between the blades. The blades are brought into engagement with the top and bottom surfaces of the workpiece. An increasing force is exerted on each blade, urging the blades towards each other. As the forces on the blades are increased, the workpiece splits, generally along a vertical surface in alignment with the blades.

These machines are useful for the high-speed processing of blocks. They produce a somewhat irregular, "rock-face" or "split-face" finish on the blocks. No two faces resulting from this process are identical, so the blocks are more natural in appearance than standard, non-split blocks. However, the edges of the faces resulting from the industry-standard splitting process are generally well-defined, i.e., more or less regular and "sharp". These blocks can be made to look more natural if the regular, sharp edges of their faces are eliminated.

One known process for eliminating the sharp edges on concrete blocks is the process known as tumbling. In this process, a relatively large number of blocks are loaded into a drum which is rotated around a generally horizontal axis. The blocks bang against each other, knocking off the sharp edges, and also chipping and scarring the edges and faces of the blocks. The process has been commonly used to produce a weathered, "used" look to concrete paving stones. These paving stones are typically relatively small blocks of concrete. A common size is 3.75 inches wide by 7.75 inches long by 2.5 inches thick, with a weight of about 6 pounds.

There are several drawbacks to the use of the tumbling process. In general, tumbling is a costly process. The blocks must be very strong before they can be tumbled. Typically, the blocks must sit for several weeks after they have been formed to gain adequate strength needed for the tumbling process. This means they must be assembled into cubes, typically on wooden pallets, and transported away from the production line for the necessary storage time. They must then be transported to the tumbler, depalletized, processed through the tumbler, and recubed and repalletized. All of this "off-line" processing is expensive. Additionally, there can be substantial spoilage of blocks that break apart in the tumbler. This is especially a factor if the blocks to be tumbled include integral concrete locator features, or if the blocks include relative thin webs (as is typically the case with architectural masonry units) that can crack during the tumbling process. Tumbling can also result in the edges of the block, although no longer sharp, being very regular. The tumbling apparatus itself can be quite expensive and a high maintenance item.

Another option for eliminating the sharp, regular edges and for creating an irregular face on a concrete block is to use a hammer mill-type machine. In this type of machine, rotating hammers or other tools attack the face of the block to chip away pieces of it. These types of machines are typically expensive, and require space on the production line that is often not available in block plants, especially older plants. This option can also slow down production if it is done "in line", because the process can only move as fast as the hammer mill can operate on each block, and the blocks typically need to be manipulated, e.g. flipped over and/or rotated, to attack all of their edges. If the hammer mill-type process is done off-line, it creates many of the inefficiencies described above with respect to tumbling.

Yet another option for creating a more natural block face appearance and eliminating the sharp, regular edges of concrete blocks is disclosed in commonly assigned, copending U.S. patent application Ser. No. 09/884,795 (filed Jun.

19, 2001), and Ser. No. 09/691,864 (filed Oct. 19, 2000), and in U.S. Pat. No. 6,321,740, which are incorporated herein by reference in their entirety. As disclosed in these documents, a splitting assembly is provided with a plurality of projections that are positioned to engage the workpiece adjacent what will be the front face of the resulting block to create an irregular front surface and an irregular upper or lower front edge on the resulting block.

As disclosed in U.S. patent application Ser. No. 10/103,155 (filed Mar. 20, 2002), and Ser. No. 10/411,453 (filed Apr. 10, 2003), smaller projections in the form of a multiplicity of small peaks can be used in place of, or to supplement the action of, the larger projections mentioned in the preceding paragraph to eliminate the sharp, regular edges of concrete blocks. As described in these two applications, the peaks are positioned to engage the workpiece adjacent what will be the front face of the resulting block to help create an irregular upper or lower front edge on the resulting block. The left and right front edges are not generally affected by the peaks and tend to remain somewhat regular. However, in many applications, including masonry blocks and retaining wall blocks, the left and right side edges are also visible edges during use of the blocks, and it would be advantageous to eliminate the sharp regularity of the left and right side edges in addition to the upper and lower front edges.

Accordingly, there is a need for equipment and a process that can create irregular edges on all of the edges of a concrete block front face. The results should be achieved in a manner that does not slow down the production line, does not add costly equipment to the line, does not require additional space on a production line, and is not labor-intensive.

SUMMARY OF THE INVENTION

The invention relates to equipment and related methods for producing a concrete block with irregular edges on all the edges of the block front face.

In one aspect of this invention, a block splitting assembly for splitting a concrete workpiece having a top surface, a bottom surface, and opposite side surfaces to form at least one concrete block with a generally vertical, irregular front face, irregular edges around the front face and a rear face opposite the front face comprises a first block splitter configured and positioned to split the workpiece so as to result in the at least one concrete block with the generally vertical, irregular front face. The block splitting assembly also includes first, second, third and fourth edge roughening members, where the first member is positioned to engage the top surface of the workpiece, the second member is positioned to engage the bottom surface of the workpiece, the third member is positioned to engage one of the side surfaces of the workpiece, and the fourth member is positioned to engage the other side surface of the workpiece. Each edge roughening member includes a multiplicity of peaks that are positioned to engage the respective workpiece surface adjacent the front face of the resulting concrete block, the multiplicity of peaks including peaks distributed over a distance parallel to the front face of the resulting concrete block and peaks distributed over a distance away from the front face of the resulting concrete block toward the rear face of the resulting concrete block. The peaks are positioned to engage the respective surface of the workpiece and roughen an edge of the resulting concrete block along the generally vertical front face of the resulting concrete block during the splitting operation. In addition, the multiplicity of peaks of each of the first, second, third and fourth edge roughening members are configured and positioned to engage the respective workpiece surfaces and roughen the majority of the length of each of the edges along the generally vertical front face of the resulting concrete block.

In yet another aspect of the invention, a method of producing a concrete block having a generally vertical, irregular front face and irregular edges around the front face, comprises:

i) providing a block splitting assembly including a first activatible block splitter that is configured and positioned to split a concrete workpiece so as to result in the concrete block with the generally vertical, irregular front face, and first, second, third and fourth activatible edge roughening members, the first member positioned to engage a top surface of the workpiece, the second member positioned to engage a bottom surface of the workpiece, the third member positioned to engage a side surface of the workpiece, and the fourth member positioned to engage a side surface of the workpiece opposite the side surface engaged by the third member, the edge roughening members being configured and positioned to roughen the upper, lower, left and right front edges of the resulting concrete block along a majority of the length thereof along the front face of the resulting concrete block when the edge roughening members engage the respective surfaces of the workpiece;

ii) locating a concrete workpiece in the block splitting assembly at a position to be engaged by the first block splitter and by the edge roughening members; and iii) activating the first block splitter to split the workpiece and activating the edge roughening members to engage the respective workpiece surfaces and roughen the upper, lower, left and right front edges of the resulting concrete block along a majority of the length thereof along the front face of the resulting concrete block.

These and various other advantages and features of novelty which characterize the invention are pointed out with particularity in the claims annexed hereto and forming a part hereof. However, for a better understanding of the invention, its advantages and objects obtained by its use, reference should be made to the drawings which form a further part hereof, and to the accompanying description, in which there is described a preferred embodiment of the invention.

DETAILED DESCRIPTION OF THE PREFERRED EMBODIMENT

The invention relates to the splitting of concrete workpieces to create a more natural appearance on the faces of concrete blocks that result from splitting the workpieces. The concrete blocks may be concrete masonry blocks that in use are laid up in courses with mortar between the blocks to secure the blocks to one another. Alternatively, the concrete blocks may be concrete wall blocks, such as retaining wall blocks or free standing wall blocks, that are dry stacked in ascending courses without the use of mortar between the blocks. The invention will be described in detail below with respect to the formation of concrete masonry blocks. However, it is to be understood that the concepts described herein can be applied to the formation of concrete retaining wall blocks, and other concrete blocks.

Equipment and processes that create a more natural appearing block face and which eliminate the regular, sharp upper and lower face edges are disclosed in commonly assigned, copending U.S. patent application Ser. Nos. 10/103,155 and 10/411,453, which applications are incorporated herein by reference in their entirety. As disclosed in each application, upper and lower splitting assemblies can be provided with smaller projections in the form of a multiplicity of peaks that are distributed over a distance parallel to the front face of the resulting block and distributed over a distance away from the front face of the resulting block. The peaks are positioned to engage the workpiece adjacent what will be the front face of the resulting block to create irregular upper and lower front edges on the resulting block. A typical workpiece that is split is formed by two blocks molded from no-slump concrete in a face-to-face arrangement so that splitting of the workpiece creates irregular front faces on both blocks. When used on upper and lower splitting assemblies, the peaks have minimal or no impact on the left and right front edges on the resulting block so that the left and right front edges remain sharp and regular compared to the upper and lower front edges.

Figure 1:
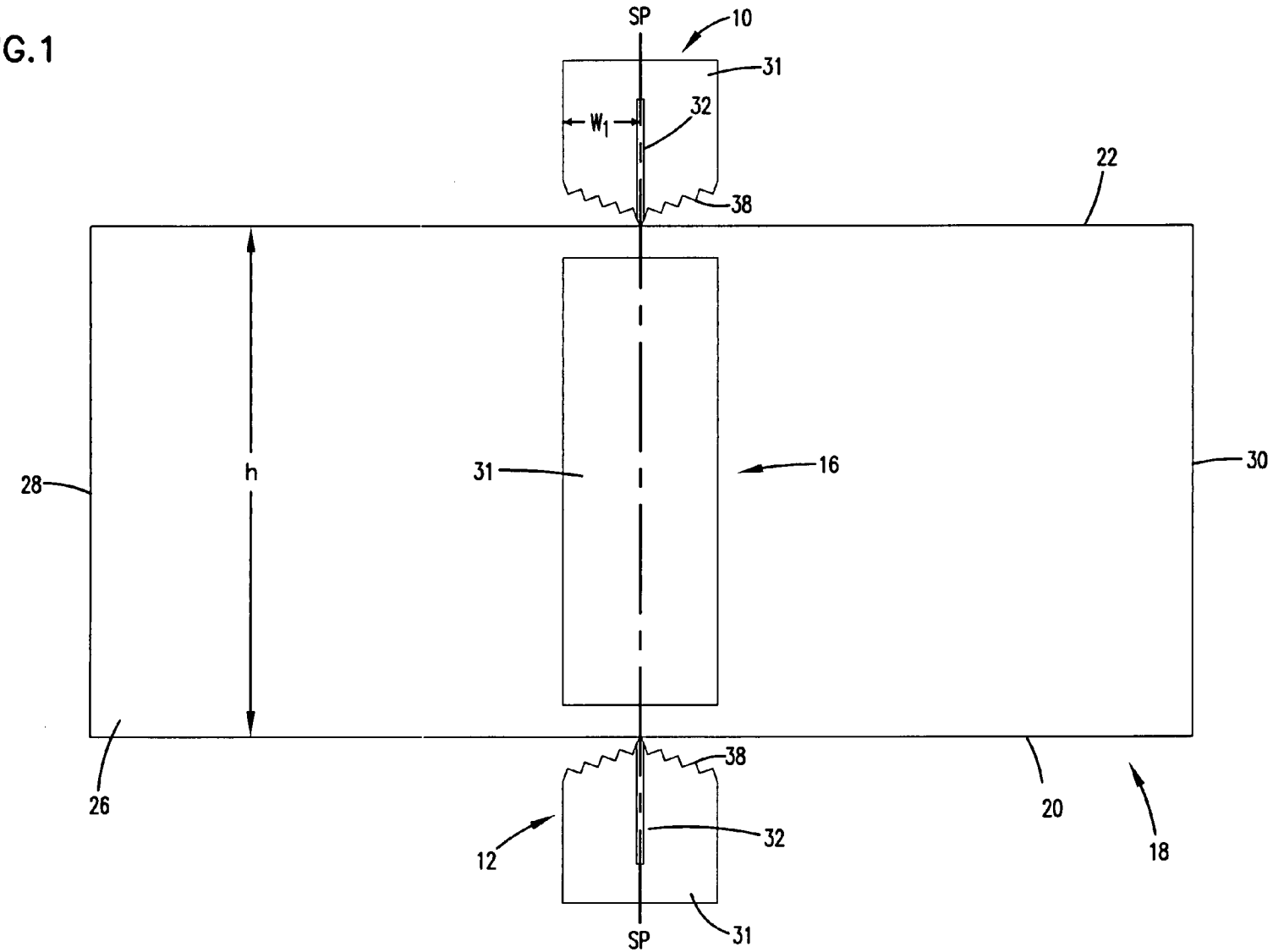
FIG. 1 is a side view of a concrete workpiece with opposed top and bottom splitting assemblies and a side splitting assembly positioned to split the workpiece into two concrete blocks, the illustrated splitting assemblies having a multiplicity of peaks according to the invention.
Figure 2:
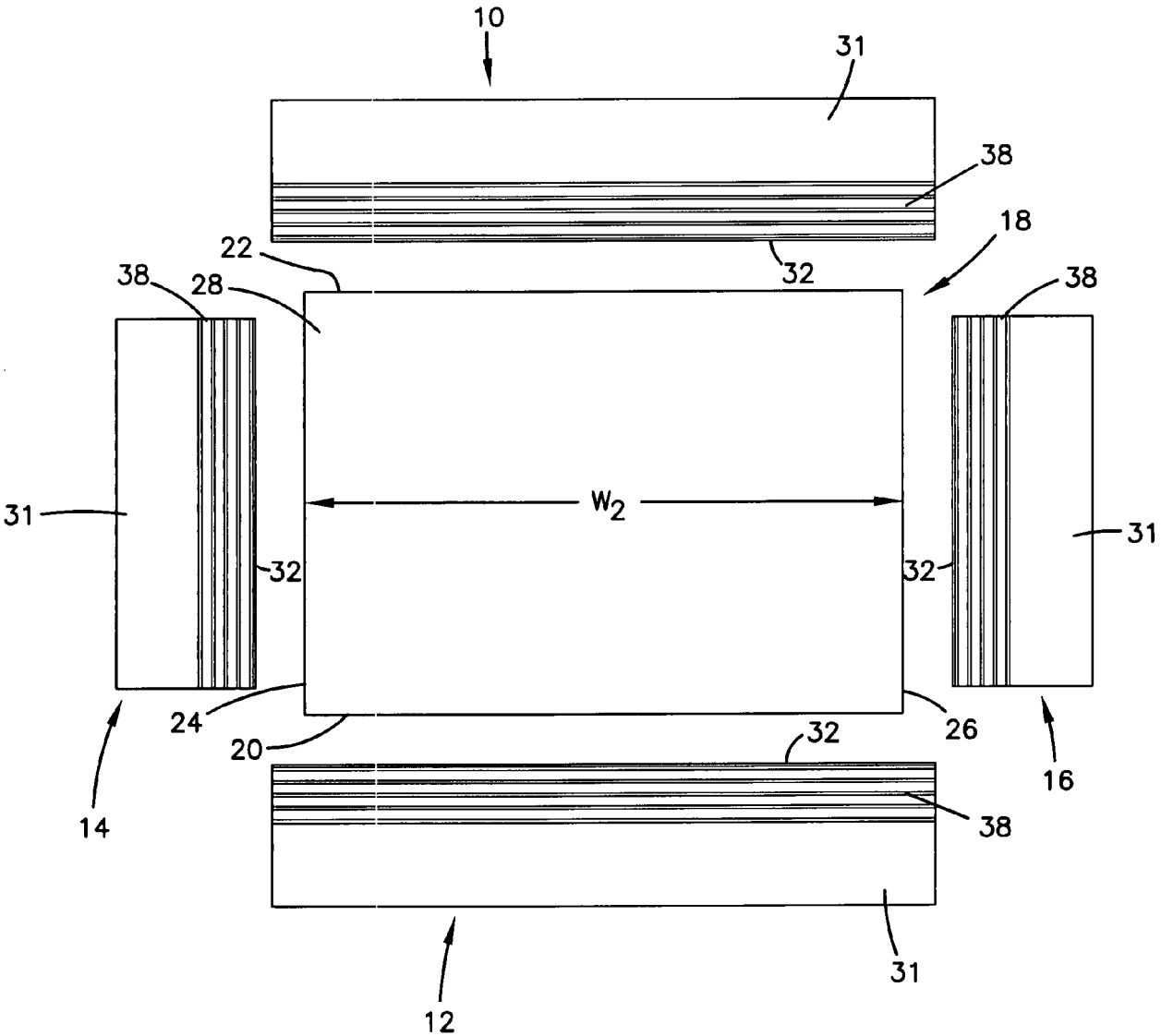
FIG. 2 is an end view of the concrete workpiece illustrating the top and bottom splitting assemblies and opposed side splitting assemblies of the block splitting assembly positioned to split the workpiece.

Attention is now directed to the figures where like parts are identified with like numerals. FIG. 1 illustrates top and bottom splitting assemblies 10, 12 of a block splitting assembly in accordance with the invention positioned relative to an adequately cured workpiece 18 that is to be split to form two blocks. In addition, FIGS. 1 and 2 illustrate a third or left side splitting assembly 14 of the block splitting assembly that is disposed opposite a fourth or right side splitting assembly 16 positioned relative to the workpiece 18. It is preferred that the split pieces that result from splitting the workpiece 18 each be a concrete block, and the invention will be hereinafter described with respect to the production of two concrete blocks. However, one split piece could be a concrete block while the other split piece is a waste piece.

Figure 3:
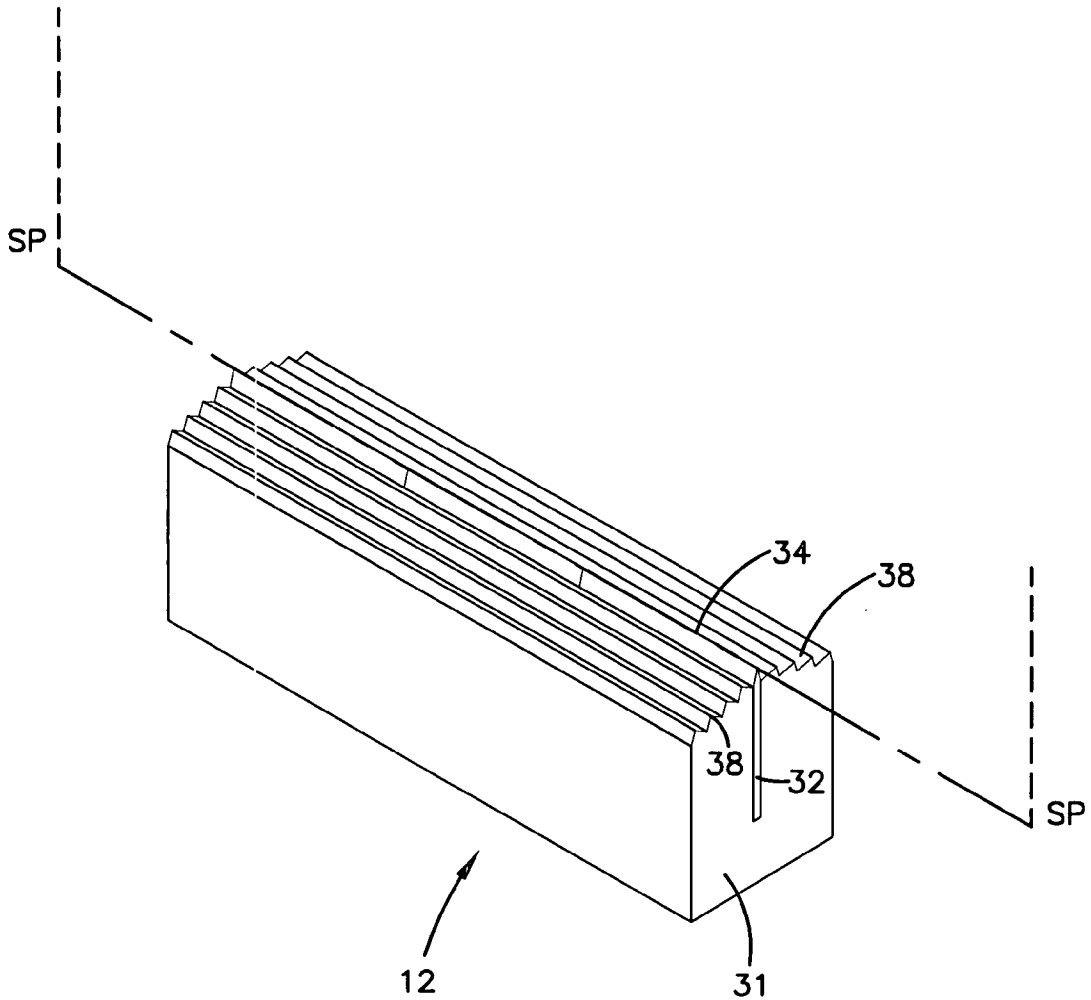
FIG. 3 is a perspective view of the bottom splitting assembly.

The splitting assemblies 10, 12, 14, 16 are utilized in a block splitting assembly of a block splitting machine. The block splitting assembly has a generally vertical splitting plane SP which in the illustrated embodiment generally bisects the workpiece 18 when the workpiece 18 is properly positioned relative to the block splitting assembly in a ready-to-split position. The splitting plane SP is illustrated in dashed lines in FIGS. 1 and 3. The splitting plane SP is typically an imaginary plane in the block splitting assembly. However, the splitting plane SP could be denoted by suitable indicators provided in the block splitting assembly to provide a visual reference to users of the splitting machine. The splitting assemblies 10, 12, 14, 16 are positioned relative to each other so as to split the workpiece 18 generally along the splitting plane.

When referring to the splitting assemblies 10, 12, 14, 16, the terms "bottom", "top", "upper", and "lower", refer to the positions of the splitting assemblies 10, 12 relative to the workpiece 18 during splitting as shown in FIGS. 1 and 2, while the terms "left", "right" and "side(s)" refer to the positions of the splitting assemblies 14, 16 relative to the workpiece 18 during splitting when viewed from the orientation shown in FIG. 2. Likewise, when referring to the workpiece 18, the terms "bottom", "top", "upper", "lower", "left", "right", "sides" and "ends" refer to the particular workpiece surfaces as they are oriented during splitting.

When referring to the resulting block or resulting blocks, the terms "upper", "lower", "left" and "right" front edges refer to the edges of the blocks immediately after splitting while it is positioned in the block splitting assembly.

The workpiece 18 is generally rectangular with a generally horizontal and planar bottom surface 20, a generally horizontal and planar top surface 22 parallel to the bottom surface 20, a generally vertical and planar left side surface 24, a generally vertical and planar right side surface 26, a first generally vertical and planar end surface 28 and a second generally vertical and planar end surface 30.

The illustrated workpiece 18 is configured so that the blocks resulting from splitting the workpiece are concrete masonry blocks. Blocks of this type require the use of mortar between the blocks to secure the blocks to each other when the blocks are laid up in courses. These blocks are particularly suited for use in constructing residential basement walls that are visible when the construction is completed, such as walk out basement walls.

As illustrated in FIGS. 1 and 2, the top splitting assembly 10 is positioned to engage the top surface 22 of the workpiece, the bottom splitting assembly 12 is positioned to engage the bottom surface 20, the left side splitting assembly 14 is positioned to engage the left side surface 24, and the right side splitting assembly 16 is positioned to engage the right side surface 26.

The bottom splitting assembly 12 is adapted to move upward through an opening in a support table (not shown) in a manner known in the art, to engage the bottom surface 20 of the workpiece 18 during the splitting operation. The bottom splitting assembly 12 moves downward through the opening back to a home or "resting" position after completion of the splitting operation so that the blocks can be removed from the splitting assembly and another workpiece can be positioned for splitting. The support table supports the workpiece 18 during splitting.

In addition, the top splitting assembly 10 is positioned above the workpiece 18, opposite the bottom splitting assembly 12, in order to engage the top surface 22 of the workpiece during a splitting operation. The top splitting assembly 10 is mounted so as to be moveable downward to engage and split the workpiece 18, and to be moveable upward to a home position so that a subsequent workpiece can be positioned for splitting.

Likewise, the left and right side splitting assemblies 14, 16 are positioned opposite each other, and are mounted so as to be moveable sideways into engagement with the workpiece 18, and to be moveable back to a home position so that another workpiece can be positioned for splitting. The mechanisms for causing movement of the splitting assemblies 10, 12, 14, 16 are well known to persons having ordinary skill in the art.

The splitting assemblies 10, 12, 14, 16 are similar in construction and operation, and only the bottom splitting assembly 12 will be described in detail.

With reference to FIG. 1, the bottom splitting assembly 12 includes a block splitter holder 31 having a block splitter 32 secured thereto. In the embodiment illustrated, the holder 31 comprises a blade holder, and the block splitter 32 comprises a splitting blade. For sake of convenience, the invention will hereinafter be described by referring to "blade holder 31" or "holder 31" and "splitting blade 32" or "blade 32". However, it is to be realized that the holder 31 and the splitter 32 (as well as the holder and splitter of the other splitting assemblies 10, 14, 16) could be formed by structures other than those illustrated.

The blade 32 is positioned to engage the bottom surface 20 of the workpiece and split the workpiece along the splitting plane so as to result in two concrete blocks each having a generally vertical, irregular front face. The blade 32 includes a splitting edge 34 that is aligned with the splitting plane SP along which the workpiece will be split. In the preferred embodiment, the splitting plane SP is along a generally straight line, and the resulting split face of each block will be generally straight from side face to side face as a result. However, the splitting plane could take on other configurations, such as, for example, curved, if desired, in which case the splitting edge 34 would be curved so as to produce a split face that is curved from side face to side face. In the illustrated embodiment, the front face of each resulting block will be generally parallel to the splitting plane SP and generally parallel to the splitting edge 34.

The blade 32 is a wear location during the splitting process. It is preferred that the blade 32 be removable and replaceable, so that as the blade wears, it can be replaced as needed. The blade 32 can be secured to the blade holder 31 through any number of conventional removable fastening techniques, such as by bolting the blade to the blade holder, with the blade being removably disposed within a slot formed in the blade holder as shown in FIG. 1.

Figure 4:
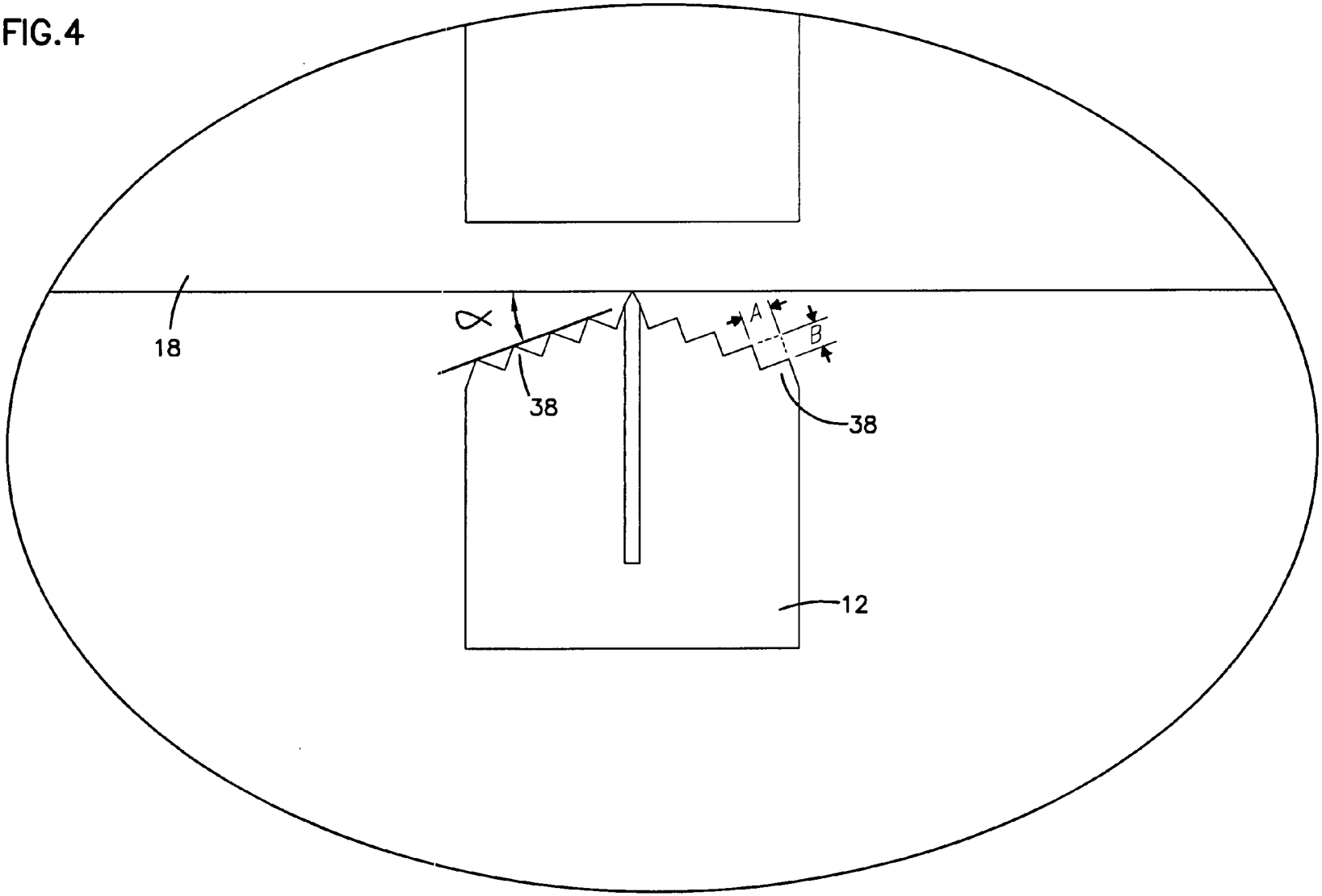
FIG. 4 is an end view of the bottom splitting assembly illustrating the detail of the peaks.

In addition, the splitting assembly 12 includes an edge roughening member on each side of the blade 32. In the illustrated embodiment, each edge roughening member is defined by the blade holder 31 that includes projections in the form of a multiplicity of peaks that are positioned to engage the workpiece surface adjacent what will be the front face of each of the resulting blocks. The peaks are distributed over a distance parallel to the front face of the resulting block and are distributed over a distance away from the front face of the block toward the rear face 28, 30 of the blocks, as shown in FIGS. 1 and 4.

The peaks chip and break away portions of the lower surfaces of each of the blocks along and adjacent to what will be the front faces of the resulting blocks in a random fashion adjacent the splitting plane during the splitting process, thereby roughening the lower surface. As a result, the front, lower edges of the blocks are roughened. Preferably, the peaks are configured and positioned to roughen a majority of the length of the front, lower edges of the blocks.

In the preferred embodiment, the multiplicity of peaks distributed over a distance parallel to the front faces of the resulting blocks are joined together to form a plurality of ridges 38 extending parallel to the splitting edge 34 of the blade 32 and to the front faces of the blocks, with valleys or grooves defined between adjacent ridges 38. The alternating ridges 38 and valleys form a generally serrated or saw-toothed appearance when viewed from the end, as shown in FIG. 4. The ridges 38 are preferably angled in a direction toward the workpiece 18, and preferably have sharp tips.

As an alternative to the ridges 38, the multiplicity of peaks could comprise a multiplicity of pyramid-shaped projections arranged in a checkerboard pattern distributed over a distance parallel to and away from the front faces of the resulting blocks.

The ridges 38 preferably extend from adjacent the blade 32 across a width $w_1$ to the outer surface of the blade holder 31 and preferably extend along substantially the entire length of the blade holder 31. Therefore, the ridges 38 occupy a total distance along the splitting plane that is the majority of the width $w_2$ of the workpiece 18 and, as a result, a majority of the length of the front face of the resulting block. This ensures that the majority of the length of the edge of the resulting block along the front face is roughened by the ridges. Preferably, for the top and bottom splitting assemblies 10, 12, the ridges extend at least substantially the entire length of the front face of the resulting block, so that substantially the entire length of the edge is roughened.

As indicated in FIG. 4, the ridges 38 have tips that lie generally on a plane that is at an acute angle $\alpha$ relative to a horizontal plane. As a result, as the ridges 38 extend away from the blade 32, the tips of the ridges 38 that are further from the front faces of the resulting blocks are further from the workpiece surface than are the tips of the ridges that are closer to the front faces. The angle $\alpha$ is preferably between about 15 degrees and about 45 degrees relative to horizontal, as best seen in FIG. 4. More preferably, the angle $\alpha$ is between about 20 degrees and about 30 degrees, and most preferably the angle $\alpha$ is about 20 degrees.

The angle $\alpha$ of the tips of the ridges of the top and bottom splitting assemblies 10, 12 are preferably equal to each other, and the angle $\alpha$ of the tips of the ridges of the left and right splitting assemblies 14, 16 are preferably equal to each other. Most preferably, the angle $\alpha$ of the tips of the ridges of each splitting assembly 10, 12, 14, 16 are equal to each other.

The angle $\alpha$ of the tips of the ridges affect the roughening that occurs. Further, the height A and length B of the ridges also affects the roughening that occurs. The following table lists various dimensions for the ridges that have been found to achieve satisfactory roughening.

| Block/Workpiece Height h (inches) | $\alpha$ | Ridge Height A (inches) | Ridge Length B (inches) |
|---|---|---|---|
| 3 - cap blocks | 20 degrees | 0.25 | 0.21 |
| 6 | 20 degrees | 0.25 | 0.21 |
| 8 | 20 degrees | 0.25 | 0.21 |

With the above described construction, the top splitting assembly 10 is configured so that its blade 32 and the ridges 38 extend generally parallel to the splitting plane SP and parallel to the front faces of the resulting blocks. Likewise, the blade 32 and the ridges 38 of the bottom splitting assembly 12 extend generally parallel to the splitting plane SP and parallel to the front faces of the resulting blocks.

The blade 32 and ridges 38 of the left and right side splitting assemblies 14 and 16 extend generally vertically, and generally parallel to the front faces of the resulting blocks, and generally parallel to the plane of the left and right side surfaces 24 and 26 of the workpiece 18.

As illustrated in FIGS. 1 and 2, the blade holders 31 of the left and right side splitting assemblies 14 and 16 each has a vertical length that is less than the vertical height h of the workpiece 18 and resulting blocks. Preferably, the side splitting assemblies 14 and 16 are positioned so that the top end of the blade holder 31 is spaced below the top surface of the workpiece and the bottom end of the blade holder 31 is spaced above the bottom surface of the workpiece. This arrangement prevents contact between the side splitting assemblies 14 and 16 and the top and bottom splitting assemblies 10, 12 during a splitting operation. However, the length of the blade holder 31 of the side splitting assemblies 14 and 16 is such that the ridges 38 occupy a total distance along the blade 32 that is a majority of the height of the workpiece 18 and a majority of the height of the front face of the resulting block. As a result, the ridges roughen the majority of the front, side edges of the blocks.

The following is an exemplary explanation of the operation of the splitting assemblies 10, 12, 14, 16 as used on a Lithibar 6386 splitting assembly available from Besser Company of Alpena, Mich. In the Lithibar 6386, the bottom assembly 12 is not independently powered. Instead, the bottom assembly 12 is actuated by the top splitting assembly 10 so that as the top assembly 10 contacts the top of the workpiece, the bottom assembly 12 is actuated by the movement of the top assembly 10 into engagement with the bottom of the workpiece. The result is that the top splitting assembly 10 contacts the workpiece prior to the bottom splitting assembly 12. Further, when the top splitting assembly 10 is about to contact the workpiece 18, the side splitting assemblies 14, 16 are also about to contact the workpiece. The side splitting assemblies 14, 16 preferably have a height that is at most about 1.0 inch less than the height of the workpiece 18. Therefore, if the height of the workpiece is, for example, 8.0 inches, then the height of each side splitting assembly is at most about 7.0 inches. Further, the top and bottom splitting assemblies 10, 12 and the side splitting assemblies 14, 16 preferably penetrate the workpiece 18 the same distance. For example, the splitting assemblies 10, 12, 14, 16 can each penetrate the workpiece a distance of from about 0.5 inch to about 1.0 inch. The amount of penetration of the splitting assemblies and the height of the side splitting assemblies 14, 16 will be chosen to prevent contact of the side splitting assemblies with either the top or the bottom splitting assembly.

Figure 5:
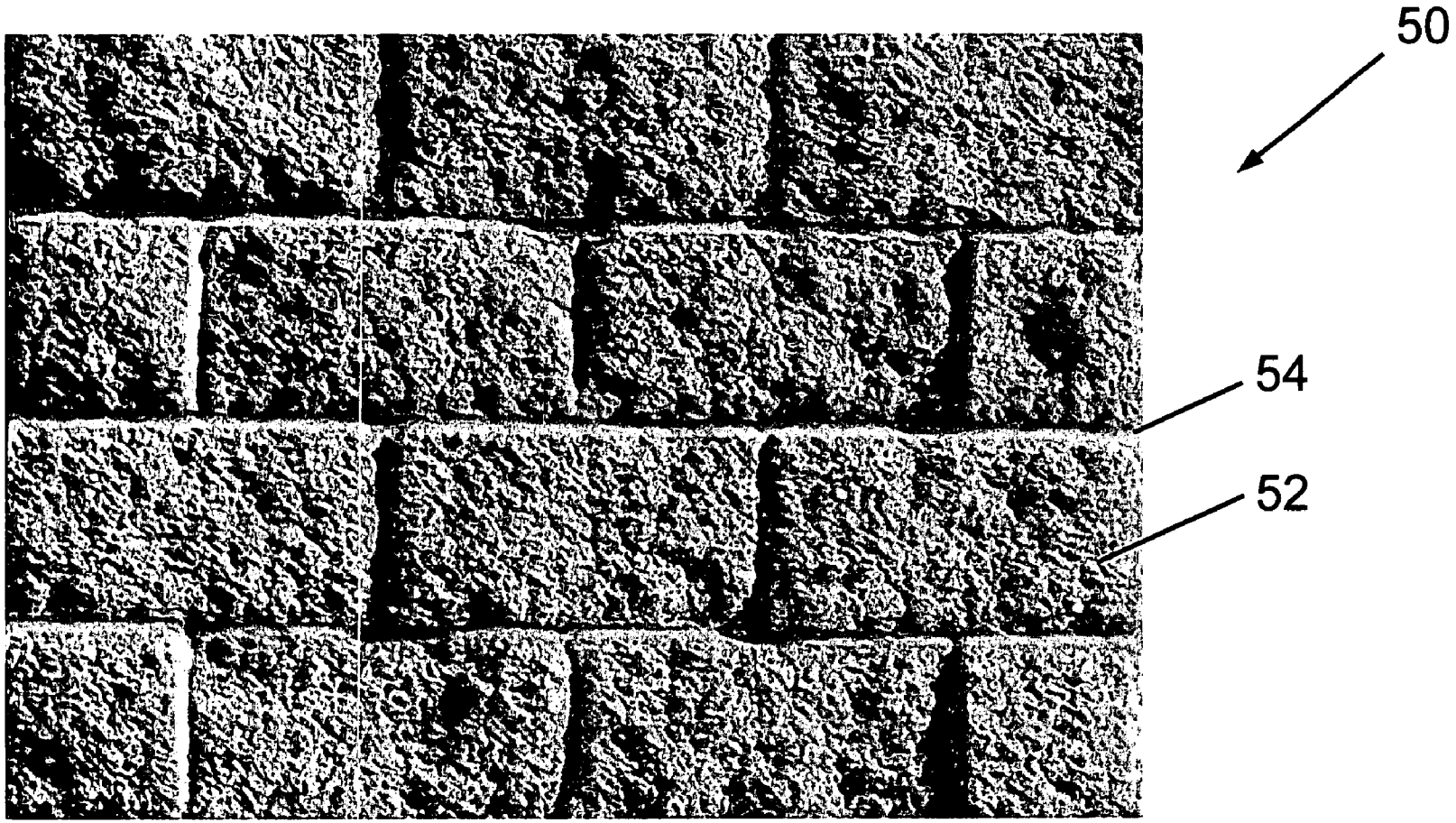
FIG. 5 is a view of a portion of a wall constructed from a plurality of the blocks that result from being split by the top, bottom and side splitting assemblies according to the invention.

A portion of a wall 50 that is constructed from a plurality of blocks 52 resulting from splitting the workpiece 18 using splitting assemblies of the type described herein is illustrated in FIG. 5. The blocks 52 are masonry blocks. Each block 52 includes a block body with a generally planar top surface, a generally planar bottom surface, a pair of generally planar side surfaces, a front surface, and a rear surface. The front surface of each block is generally the same width as the rear surface. Mortar 54 placed between the blocks when forming the wall 50 serves to hold the blocks together thereby providing structural integrity to the wall.

As seen in FIG. 5, the front surface of each block 52 has an irregular, rock-like texture. In addition, the upper edge, lower edge, and side edges of the front surface are also irregular as a result of the splitting assemblies 10, 12, 14, 16. In addition, the ridges 38 of the splitting assemblies 10, 12, 14, 16 roughen portions of the top, bottom, and side edges of each block adjacent the front face of each block. This action helps to make the visible portions of the blocks more "natural" looking.

The invention claimed is:

1. A block splitting assembly for splitting a concrete workpiece having a top surface, a bottom surface, and opposite side surfaces to form at least one concrete block with a generally vertical, irregular front face, irregular edges around the front face and a rear face opposite the front face, comprising:

a) a first block splitter configured and positioned to split the workpiece so as to result in the at least one concrete block with the generally vertical, irregular front face;

b) first, second, third and fourth edge roughening members, the first member positioned to engage the top surface of the workpiece, the second member positioned to engage the bottom surface of the workpiece, the third member positioned to engage one of the side surfaces of the workpiece, and the fourth member positioned to engage the other side surface of the workpiece;

c) each edge roughening member including a multiplicity of peaks that are positioned to engage the respective workpiece surface adjacent the front face of the resulting concrete block, the multiplicity of peaks including peaks distributed over a distance parallel to the front face of the resulting concrete block and peaks distributed over a distance away from the front face of the resulting concrete block toward the rear face of the resulting concrete block, the peaks being positioned to engage the respective surface of the workpiece and roughen an edge of the resulting concrete block along the generally vertical front face of the resulting concrete block during the splitting operation; and (i) for each of the third and fourth edge roughening members, (A) the multiplicity of peaks are joined together to form a plurality of alternating ridges and valleys;

(B) the peaks have tips that lie generally on a plane that is at an acute angle relative to a vertical plane extending parallel to the front face of the resulting concrete block;

(C) the ridges and valleys extend less than the entire height of the front face of the resulting block; and d) the multiplicity of peaks of each of the first, second, third and fourth edge roughening members being configured and positioned to engage the respective workpiece surfaces so that the majority of the length of each of the edges along the generally vertical front face of the resulting concrete block is roughened.

2. The block splitting assembly of claim 1, wherein, for each edge roughening member, the tips of the peaks that are further from the generally vertical front face of the resulting concrete block are further from the respective surface of the workpiece when the edge roughening member is in its rest position prior to the splitting operation.

3. The block splitting assembly of claim 1, wherein, for each of the first and second edge roughening members, the multiplicity of peaks are joined together to form a plurality of alternating ridges and valleys.

4. The block splitting assembly of claim 3, wherein the ridges are parallel to the front face of the resulting concrete block.

5. The block splitting assembly of claim 3, wherein, for each edge roughening member, the ridges have sharp tips.

6. The block splitting assembly of claim 1, further comprising a second block splitter positioned opposite the first block splitter to engage a surface of the workpiece opposite the surface engaged by the first block splitter, wherein the first and second block splitters together split the workpiece along the front face of the resulting concrete block.

7. The block splitting assembly of claim 6, wherein the first block splitter with the first edge roughening member forms a first splitting assembly, and the second block splitter with the second edge roughening member forms a second splitting assembly.

8. The block splitting assembly of claim 7, further comprising a third block splitter that together with the third edge roughening member forms a third splitting assembly, and a fourth block splitter that together with the fourth edge roughening member forms a fourth splitting assembly.

9. The block splitting assembly of claim 8, wherein each block splitter comprises a splitting blade.

10. The block splitting assembly of claim 8, wherein, for each of the first, second, third and fourth splitting assemblies, the block splitter is detachably mounted so that it can be removed separately from the multiplicity of peaks.

11. The block splitting assembly of claim 1, wherein each edge roughening member comprises a multiplicity of peaks that are positioned to engage the respective workpiece surfaces adjacent the front faces of two concrete blocks that result from the splitting operation to form two concrete blocks with irregular front faces and roughened edges around the front faces.

12. The block splitting assembly of claim 1, wherein, for the first and second edge roughening members, the peaks have tips that lie generally on a plane that is at an acute angle relative to a horizontal plane.

13. The block splitting assembly of claim 12, wherein each acute angle is between about 15 degrees and about 45 degrees.

14. The block splitting assembly of claim 3, wherein, for the first and second edge roughening members, the ridges and valleys extend at least substantially the entire length of the front face of the resulting block.

15. A method of producing a concrete block having a generally vertical, irregular front face and irregular edges around the front face, comprising:

i) providing a block splitting assembly including a first activatible block splitter that is configured and positioned to split a concrete workpiece so as to result in the concrete block with the generally vertical, irregular front face, and first, second, third and fourth activatible edge roughening members, the first member positioned to engage a top surface of the workpiece, the second member positioned to engage a bottom surface of the workpiece, the third member positioned to engage a side surface of the workpiece, and the fourth member positioned to engage a side surface of the workpiece opposite the side surface engaged by the third member, the edge roughening members being configured and positioned to roughen the upper, lower, left and right front edges of the resulting concrete block along a majority of the length thereof along the front face of the resulting concrete block when the edge roughening members engage the respective surfaces of the workpiece;

ii) locating a concrete workpiece in the block splitting assembly at a splitting position to be engaged by the first block splitter and by the edge roughening members; and iii) with the workpiece at the splitting position, activating the first block splitter to split the workpiece and activating the edge roughening members to engage the respective workpiece surfaces and roughen the upper, lower, left and right front edges of the resulting concrete block along a majority of the length thereof along the front face of the resulting concrete block;

wherein each edge roughening member includes a multiplicity of peaks that are positioned to engage the respective workpiece surface adjacent the front face of the resulting block, the peaks being configured to roughen a respective edge of the resulting concrete block, the multiplicity of peaks including peaks distributed over a distance parallel to the front face of the resulting concrete block and peaks distributed over a distance away from the front face of the resulting concrete block toward a rear face of the resulting concrete block, wherein for each of the third and fourth edge roughening members, (i) the multiplicity of peaks are joined together to form a plurality of alternating ridges and valleys; (ii) the peaks have tips that lie generally on a plane that is at an acute angle relative to a vertical plane extending parallel to the front face of the resulting concrete block; and (iii) the ridges and valleys extend less than the entire height of the front face of the resulting block; and wherein the multiplicity of peaks of each of the first, second, third and fourth edge roughening members are configured and positioned to engage the respective workpiece surfaces so that the majority of the length of each of the edges along the generally vertical front face of the resulting concrete block is roughened.

16. The method of claim 15, wherein the concrete workpiece is configured so that the resulting concrete block is a concrete masonry block.

17. The method of claim 15, wherein the first block splitter with the first edge roughening member form a first splitting assembly that is engageable with the top surface of the workpiece, and wherein the first block splitter and the first edge roughening member are simultaneously activated.

18. The method of claim 17, further comprising:

a second activatible block splitter positioned opposite the first block splitter to engage the bottom surface of the workpiece, the second block splitter and the second edge roughening member forming a second splitting assembly, a third activatible block splitter that together with the third edge roughening member form a third splitting assembly that is engageable with the side surface engaged by the third member, and a fourth activatible block splitter that together with the fourth edge roughening member form a fourth splitting assembly positioned opposite the third splitting assembly to engage the opposite side surface of the workpiece.

19. The method of claim 18, wherein each block splitter comprises a splitting blade.

20. The method of claim 15, wherein, for each edge roughening member, the tips of the peaks that are further from the generally vertical front face of the resulting concrete block are further from the respective surface of the workpiece when the edge roughening member is in its rest position prior to activation.

21. The method of claim 15, wherein, for each of the first and second edge roughening members, the multiplicity of peaks are joined together to form a plurality of alternating ridges and valleys.

22. The method of claim 21, wherein the ridges are parallel to the front face of the resulting concrete block.

* * * * *